US010004283B1

(12) United States Patent
Baude et al.

(10) Patent No.: US 10,004,283 B1
(45) Date of Patent: Jun. 26, 2018

(54) GARMENT WITH HEATING ELEMENTS

(71) Applicants: Jayne Baude, Boynton Beach, FL (US); Hassan Niksirat, Boynton Beach, FL (US)

(72) Inventors: Jayne Baude, Boynton Beach, FL (US); Hassan Niksirat, Boynton Beach, FL (US)

( * ) Notice: Subject to any disclaimer, the term of this patent is extended or adjusted under 35 U.S.C. 154(b) by 409 days.

(21) Appl. No.: 14/822,420

(22) Filed: Aug. 10, 2015

Related U.S. Application Data

(63) Continuation-in-part of application No. 13/347,901, filed on Jan. 11, 2012, now abandoned.

(51) Int. Cl.

| | |
|---|---|
| ***H05B 3/36*** | (2006.01) |
| ***H05B 3/34*** | (2006.01) |
| ***A41D 13/005*** | (2006.01) |
| ***H05B 3/00*** | (2006.01) |
| ***H05B 3/06*** | (2006.01) |

(52) U.S. Cl.
CPC ..... *A41D 13/0051* (2013.01); *H05B 3/0014* (2013.01); *H05B 3/06* (2013.01)

(58) Field of Classification Search
CPC . H05B 3/34; H05B 3/342; H05B 3/36; H05B 2203/036
USPC ..... 219/211, 217, 527
See application file for complete search history.

(56) References Cited

U.S. PATENT DOCUMENTS

| | | | | |
|---|---|---|---|---|
| 1,312,830 | A | 8/1919 | Camm | |
| 3,443,066 | A | 5/1969 | Weibel | |
| 3,999,037 | A | 12/1976 | Metcalf, Sr. | |
| 4,241,721 | A | 12/1980 | Holly | |
| 4,404,460 | A | 9/1983 | Kerr | |
| 4,539,714 | A * | 9/1985 | Fratti | A41D 31/0038 2/108 |
| 4,696,066 | A | 9/1987 | Ball et al. | |
| 4,827,534 | A * | 5/1989 | Haugen | H01L 31/042 136/291 |
| 5,148,002 | A * | 9/1992 | Kuo | H01Q 1/273 219/211 |
| 6,005,222 | A * | 12/1999 | Hicks | H05B 3/342 2/79 |
| 6,049,062 | A | 4/2000 | Jones | |
| 6,388,422 | B1 * | 5/2002 | Lew | G01S 19/18 2/102 |
| 2002/0146948 | A1 * | 10/2002 | Pillai | A41D 13/0051 441/106 |
| 2007/0283481 | A1 | 12/2007 | Rawlings | |
| 2009/0272337 | A1 * | 11/2009 | Pomponio | A01K 13/006 119/850 |
| 2012/0318781 | A1 * | 12/2012 | Lavin, Jr. | A41D 13/005 219/211 |

* cited by examiner

*Primary Examiner* — Michael Laflame, Jr.
(74) *Attorney, Agent, or Firm* — Aaron R. Cramer; Cramer Patent & Design, PLLC.

(57) ABSTRACT

A garment with an integral heater means comprises an outer shell assembly, flexible heating elements, a solar-based recharging means, a controlling means, and a power source. The heater means further comprises a plurality of flexible heater elements located integrally throughout an inner shell assembly affixed to the outer shell assembly. The power source comprises a built-in battery pack which is charged using a plurality of photovoltaic panels via an integral charge controller. The outer shell assembly further comprises a plurality pockets, drawstring closures, and elastic cuffs.

17 Claims, 3 Drawing Sheets

GARMENT WITH HEATING ELEMENTS

RELATED APPLICATIONS

The present invention is a continuation in-part of U.S. Non-Provisional application Ser. No. 13/347,901 filed on Jan. 11, 2012, the entire disclosures of which are incorporated herein by reference.

FIELD OF THE INVENTION

The presently disclosed subject matter is directed towards clothing. More particularly the present invention relates to clothes having heater elements powered by electricity and an ability to energize said heaters at various power levels.

BACKGROUND OF THE INVENTION

Energy costs in America are high and getting higher. Foreign oil is expensive, coal is considered by many to be environmentally suspect, issues with waste disposal from nuclear power are ongoing, and domestic production of gas and oil is insufficient to meet demand, all of which keep energy expensive.

Because of the cost of energy many American's are taking steps to reduce energy usage. One (1) easy and very effective way to reduce energy usage is to turn down the thermostat and maintain living spaces at a lower temperature. However, lower temperatures can be uncomfortable, particularly for the young, aged, and infirmed. But the money that is saved by keeping the thermometer turned down can be dramatic.

One (1) successful approach to keeping warm with the thermostat turned down is to use personal warming devices such as thick robes, hats, ear muffs, sweaters, coats, thick socks, layered clothing, blankets, and blankets with arms. While such personal warming devices are useful they are not always comfortable or completely effective. These deficiencies are particularly noticeable when one is simply relaxing and wants to be both comfortable and warm.

Another problem with prior art personal warming devices is that most are "fixed" in that they cannot be regulated or adjusted to fit the surrounding temperature. When the temperature of the surroundings changes, the personal warming devices either have to be put on or taken off. One (1) risk being too hot at one (1) time and too cold at another. Sometimes it is so cold outside that a wearer simply becomes cold no matter what.

Therefore, a new personal warming device would be beneficial. Even more beneficial would be a new personal warming device that is adjustable to fit the surrounding temperature and the needs of a user. Preferably such a new personal warming device would be able to keep a user warm in a very cold room and in a warmer room. Ideally such a new personal warming device would be portable and could work for extended periods of time indoors, outdoors, and in vehicles, and would be fully adjustable.

SUMMARY OF THE INVENTION

The principles of the present invention provide for a new personal warming device that is adjustable to fit the surrounding temperature and the needs of a user. The present invention can keep a user warm in a very cold room and in a warm room, is portable, and can be used for extended periods of time indoors, outdoors, and in vehicles and is fully adjustable.

Those principles of the present invention are incorporated in a personal warming device having an outer shell assembly with a pair of long sleeves. The personal warming device further includes an integrated electric heating assembly permanently attached to the interior of the garment and a power source that is electrically connected to the heater elements. The power source includes a battery pack with a rechargeable battery and a controller for controllably applying electrical power from the rechargeable battery to the heater elements to generate heat.

The battery pack can further include a solar-based recharging mechanism to provide power to the said battery pack. Recharging is allowed to occur whenever the personal warming device is exposed to an adequate level of ambient light regardless of whether the personal warming device is being worn and/or operated. The personal warming device beneficially includes at least two (2) layers of a heat and flame retardant material arranged such that the heater elements are disposed between the layers. The fabrics used to make up the personal warming device should be cleaned by dry-clean methods only to prevent damage to the electrical components contained within and with on.

In practice the personal warming device can take the form of a long-sleeved robe, preferably long enough to cover a major portion of the legs of a wearer. While the total amount of leg area covered may vary by specific implementation, it is envisioned that the longest version would be approximately four (4) inches above the ankle area, thus allowing for easy mobility. The personal warming device beneficially includes a plurality of complementary fasteners, such as buttons, zippers, hook-and-loop-type fasteners, snaps, or the like. Such fasteners can be sewed to the personal warming device at various points on the interior and exterior surfaces to aid in attachment, containment, closure, ore the like. The personal warming device can also include elastic knit material at the wrist, neck, and other areas to aid in heat containment.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
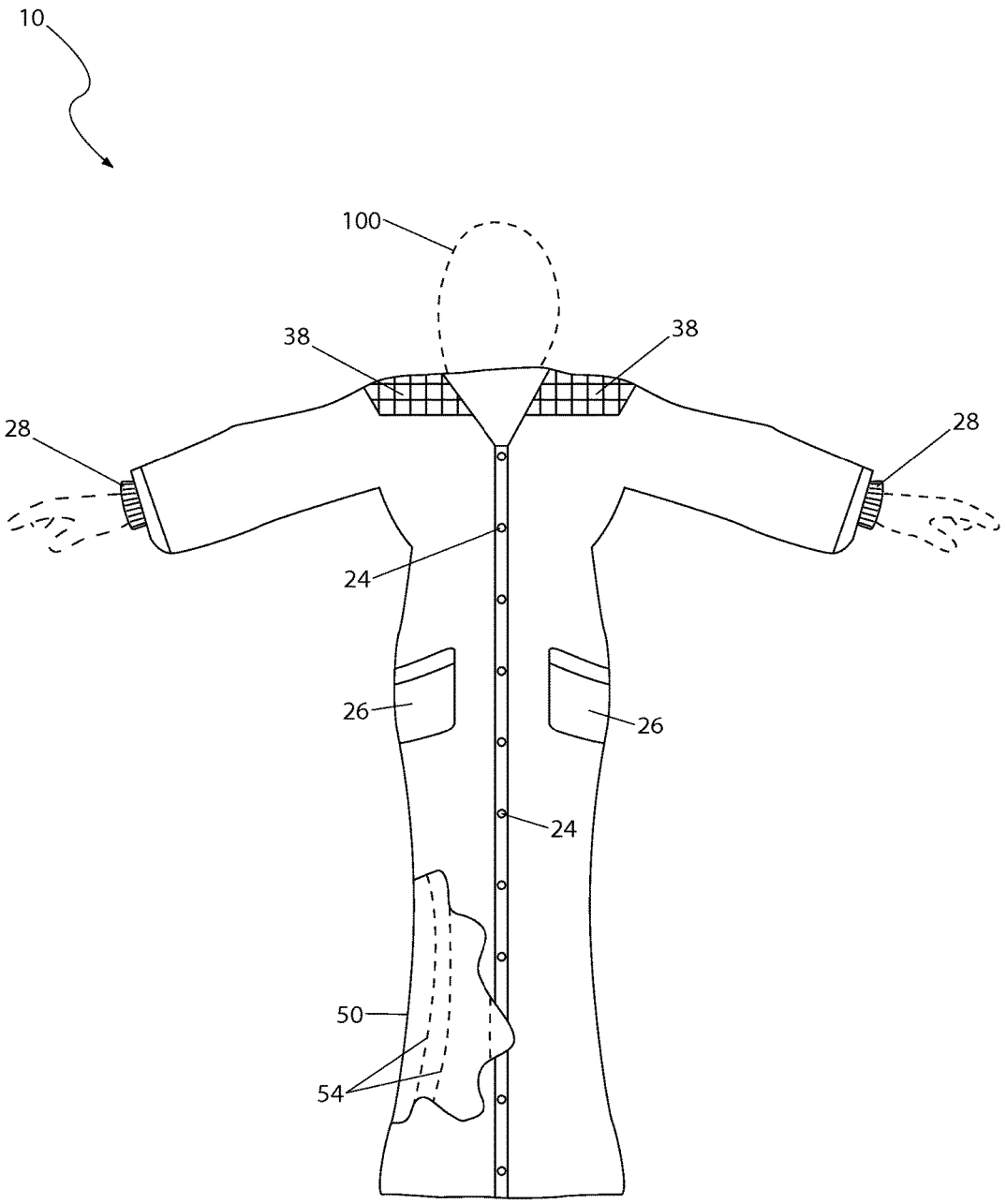
FIG. 1 depicts a front view of a preferred embodiment robe with heater elements that is in accord with the principles of the present invention.

10 garment with heater elements
20 outer shell assembly
22 outer shell
24 fasteners
26 pocket
28 elastic cuff
38 photovoltaic panels
50 inner liner
54 heater element
59 rechargeable battery
60 controller

61*a* "OFF" momentary pushbutton
61*b* "LOW" momentary pushbutton
61*c* "MEDIUM" momentary pushbutton
61*d* "HIGH" momentary pushbutton
62 solar charge controller
63*a* first controlling fastener
63*b* second controlling fastener
63*c* third controlling fastener
63*d* fourth controlling fastener
67 electrical connection to photovoltaic panels
100 user

DETAILED DESCRIPTION OF THE PREFERRED EMBODIMENT

Figure 2:
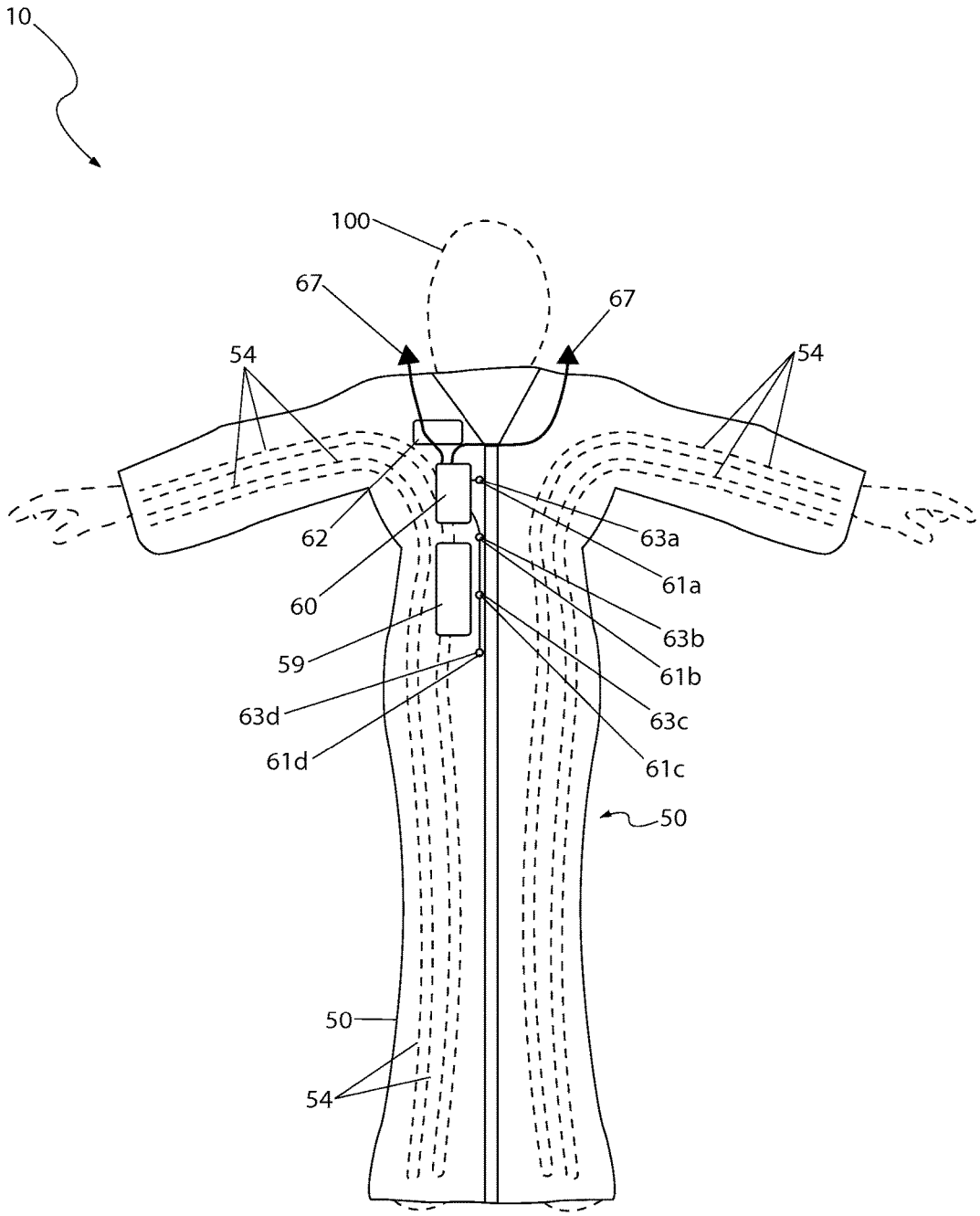
FIG. 2 depicts a front view of the interior components of the robe with heater elements contained in between the outer shell and an inner liner; and, FIG. 3 is an electrical block diagram of the robe with heater elements depicted in FIGS. 1 and 2.
Figure 3:
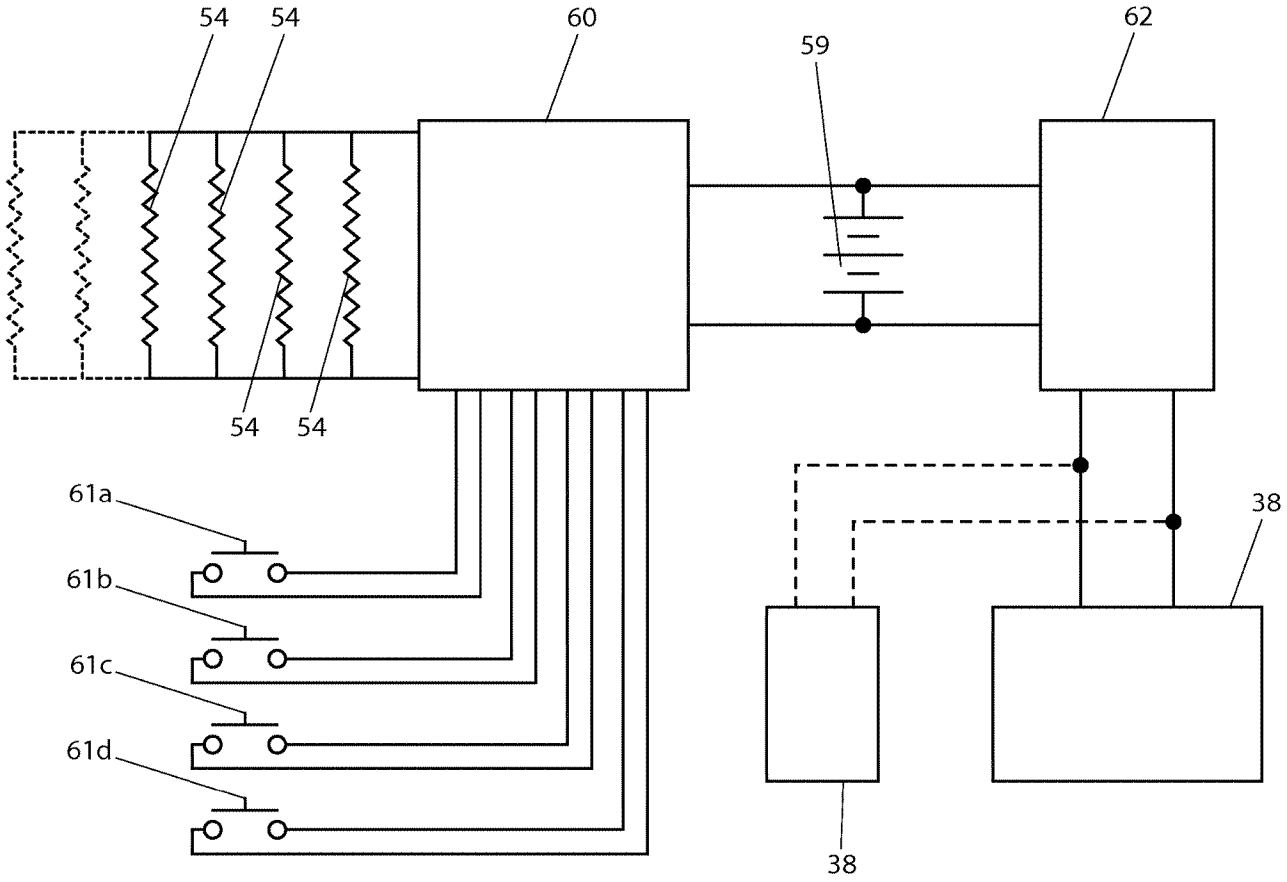

The best mode for carrying out the invention is presented in terms of its preferred embodiment, herein depicted within FIGS. 1 through 3. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

Referring to FIGS. 1 and 2 as required, the present invention is represented by a garment with heater elements 10 that provides a personal warming device that includes features of flexibility, usability, portability, and comfort. The garment with heater elements 10 includes a fabric outer shell assembly 20 and a heated inner liner assembly 50 assembled permanently as a single unit during initial manufacture. It is preferred that the inner shell assembly 50 is coextensive with the outer shell assembly 20. The outer shell assembly 20 is a sewn fabric assembly envisioned as being available in a variety of colors and preferably will include a long-sleeved robe-shaped form that extends downward to cover the lower legs of a user 100. While the total amount of leg area covered may vary by specific implementation of the present invention, it is envisioned that the longest version would be approximately four (4) inches above the ankle area, thus allowing for easy mobility. The outer shell assembly 20 is also envisioned as being made from various materials such as, but not limited to: cotton, terry cloth, polyester blend, and the like. Cleaning of the garment with heater elements 10 would be provided by a dry cleaning process. Furthermore, it is envisioned that the garment with heater elements 10 may be introduced in various sizes to suit all shapes and sizes of users 100.

Referring now specifically to FIG. 1, the outer shell assembly 20 comprises an outer shell 22 having a plurality of fasteners 24, such as buttons, which are spaced vertically downward from a neck area along a front surface, at least one (1) pocket 26, preferably located at hip and other areas, and a pair of elastic cuffs 28. The elastic cuffs 28, located at the hand openings of the garment 10, provide a means to contain heat generated by the heated inner assembly 50 by reducing drafts during wearing of the garment with heater elements 10. While the fasteners 24 are depicted as buttons, it should be noted that other types of fasteners such as snaps, hook-and-loop-type fasteners, and the like, may be used with equal effectiveness, and as such, should not be interpreted as a limiting factor of the present invention. The fasteners are located on either side of a center bisecting seam passing through the garment 10.

Referring again to FIGS. 1 and 2, the outer shell 22 includes one (1) or more photovoltaic panels 38 located near the shoulder areas thereby providing electrical power to the garment with heating elements 10. Further details on the interconnection and control of the photovoltaic panels 38 will be provided herein below.

The garment with heater elements 10 is illustrated as including features similar to a conventional robe; however, it is understood that the garment with heater elements 10 may be provided having a construction similar to other conventional garments such as shirts, pants, or coats, and as such the invention should not be interpreted as a limiting factor of the present invention. While the primary purpose of the garment with heater elements 10 is to provide supplemental heat to the user 100, it should be noted that the present invention can be used in an OFF state whereupon it functions as a conventional robe. Such versatility provides greater flexibility to the user 100 when obtaining a satisfactory state of warmth.

Referring now to FIG. 2 the inner liner 50 can provide electrically-generated heat to the user 100 via a plurality of sewed in flexible heater elements 54 which are integrated into a front surface and sleeve portions of the inner liner 50. Referring now to both FIGS. 1 and 2 the heater elements 54 are electrically connected to a controller 60. Said controller 60 is provided input control from switches, which are preferably an "OFF" momentary pushbutton 61*a*, a "LOW" momentary pushbutton 61*b*, a "MEDIUM" momentary pushbutton 61*c* and a "HIGH" momentary pushbutton 61*d*. The "OFF" momentary pushbutton 61*a*, "LOW" momentary pushbutton 61*b*, "MEDIUM" momentary pushbutton 61*c* and "HIGH" momentary pushbutton 61*d* are located in a first controlling fastener 63*a*, a second controlling fastener 63*b*, a third controlling fastener 63*c*, and a fourth controlling fastener 63*d*, respectively. The controller 60 accepts these inputs and provides a varying level of electrical power to the flexible heater elements 54. The controller receives electrical power from a rechargeable battery 59. Said rechargeable battery 59 is of a thin nature such that it may be contained between the outer shell 22 (as shown in FIG. 1) and the inner liner 50 without being readily noticeable or cumbersome. In practice the rechargeable battery 59 is envisioned as supplying 12-volt DC operating voltage or more so that adequate power levels can be supplied with a minimum amount of current.

Referring once again to FIGS. 1 and 2, the electrical power input to the controller 60 is primarily provided by the rechargeable battery 59 as aforementioned described. The rechargeable battery 59 is maintained in a suitable state of charge by a solar charge controller 62. Such charge controllers are well known in the art and ensure that a suitable charging current is maintained regardless of the voltage levels or current levels produced by the photovoltaic panels 38. The input connection to the solar charge controller 62 is provided by one (1) or more electrical connection to the photovoltaic panels 67.

FIG. 3 presents an electrical block diagram of the garment with heater elements 10. As previously noted the garment with heater elements 10 is powered by a battery pack 58 containing at least one (1) rechargeable battery 59. The rechargeable battery 59 likewise receives power from the solar charge controller 62 which receives its electrical power via the photovoltaic panels 38. Incoming power is then provided whenever ambient light levels are high enough and may occur when the user 100 is wearing the garment with heater elements 10, while the garment with heater elements 10 is placed on the back of a chair, or other location which is not shielded from light.

Also as previously noted, power from the battery 59 to the heater elements 54 is controlled via the controller 60. Varying levels of electrical power are produced using one (1) of electrical control technologies that are well-known in the art such an incremental step control, pulse wave modulation (PWM), analog control, or the like. Self-control of the varying levels such as "OFF", "LOW", "MED", and "HIGH" is provided by the user 100. Said self-control is viewed as more beneficial than automatic controls such as thermostatic controls, as various individuals will find different levels of heat more comforting depending on age, physical activity, ambient temperatures, and the like.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the garment with heater elements 10 it would be installed as indicated in FIGS. 1 and 2.

The method of utilizing the garment with heater elements 10 can be achieved by performing the following steps: recharging the batteries 59 by placing the garment with heater elements 10 in a location so that the photovoltaic panels 38 are exposed to an adequate level of ambient light for a suitable period of time; utilizing the garment with heater elements 10 during charging or after charging, as desired, by donning the garment with heater elements 10 in a normal manner; closing a front portion of the outer shell assembly 20 using the fasteners 24, as desired; utilizing either the "OFF" momentary pushbutton 61*a*, a "LOW" momentary pushbutton 61*b*, a "MEDIUM" momentary pushbutton 61*c* and a "HIGH" momentary pushbutton 61*d*, all of which are located in a first controlling fastener 63*a*, a second controlling fastener 63*b*, a third controlling fastener 63*c*, and a fourth controlling fastener 63*d* respectively; to select and obtain a desired temperature of the garment with heater elements 10; and benefiting from a temperature-adjustable personal heating garment afforded a user 100 of the garment with heater elements 10.

The garment with heater elements 10 can also be utilized in a portable and mobile manner anywhere such as inside of a home, while resting in bed or a chair/recliner, in a motor vehicle, outside of a home, while camping, while at an outdoor sporting event, or virtually anywhere an outer garment for warmth would typically be worn.

The garment with heater elements 10 can also be utilized anywhere regardless of ambient light levels. It should be noted that within low levels of ambient light (below levels where usable power is produced by the photovoltaic panels 38), the operation of the flexible heater elements 54 is afforded power only from the rechargeable batteries 59, thus total operating time is limited. In areas where suitable levels of ambient light are available, operating time is virtually unlimited due to input power from the photovoltaic panels 38 provided necessary operating power.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A personal warming device, comprising:

an outer shell assembly, comprising a head opening, a pair of hand openings each located at distal ends of a pair of sleeves, and a bottom opening, further having access provided by a fastener system;

an inner liner assembly fastened to said outer shell assembly having a permanently affixed flexible heater element system and a rechargeable battery;

one or more photovoltaic panels located on an outer surface of said outer shell assembly, each capable of providing power to said rechargeable battery;

a solar charge controller in electrical communication between said rechargeable battery and each photovoltaic panel; and, an electrical power controller electrically connected to said rechargeable battery, said controller having an input adapted for receiving input power;

wherein said controller controls electrical power applied to said heater element system;

wherein said warming device can be worn without said power applied to said heating element system.

2. The personal warming device according to of claim 1, wherein said outer shell assembly further has at least one pocket located on an outer surface thereof.

3. The personal warming device according to claim 1, wherein said inner liner assembly includes at least two layers of a heat and flame retardant material arranged such that said heater element system is disposed between said at least two layers.

4. The personal warming device according to of claim 3, wherein said heater element system comprises at least one heating element disposed along either side of a vertical centerline bisecting a front portion of said device, and each shoulder and sleeve portion of said device.

5. The personal warming device according to claim 1, wherein said fastener system includes a front fastener system.

6. The personal warming device according to claim 5, wherein said front fastener system comprises a plurality of fasteners equidistantly-spaced along a vertical centerline bisecting a front portion of said warming device.

7. The personal warming device according to claim 1, wherein said outer shell assembly and inner liner assembly is comprised of dry-clean only fabric.

8. The personal warming device according to claim 1, wherein said outer shell assembly and said inner shell assembly are coextensive.

9. The personal warming device according to claim 8, wherein said outer shell assembly is a long-sleeved robe configured to cover a portion of the lower legs of a wearer.

10. The personal warming device according to claim 1, wherein said outer shell assembly and said inner liner assembly are permanently fastened together by sewing.

11. The personal warming device according to claim 1, wherein said outer shell assembly includes elastic cuffs located at said hand openings.

12. The personal warming device according to claim 1, wherein said photovoltaic panels are located at shoulder portions of said outer shell assembly.

13. The personal warming device according to claim 1, wherein said controller input further comprises:

a solar charge controller;

an "OFF" momentary switch located on an outer surface of said outer shell assembly;

a "LOW" momentary switch located adjacent to said "OFF" momentary switch;

a "MEDIUM" momentary switch located adjacent to said "LOW" momentary switch; and, a "HIGH" momentary switch located adjacent to said "MEDIUM" momentary switch;

wherein said "LOW" momentary switch activates said heating system to a first pre-set temperature;

wherein said "MEDIUM" momentary switch activates said heating system to a second pre-set temperature, higher than said first pre-set temperature;

wherein said "HIGH" momentary switch activates said heating system to a third pre-set temperature, higher than said second pre-set temperature.

14. The personal warming device according to claim 13, wherein each said "OFF" momentary switch, said "LOW" momentary switch, said "MEDIUM" momentary switch, and said "HIGH" momentary switch is a pushbutton located within said fastener system.

15. The personal warming device according to claim 14, wherein each said "OFF" momentary switch, said "LOW" momentary switch, said "MEDIUM" momentary switch, and said "HIGH" momentary switch is a pushbutton located within an individual one of a plurality of fasteners of said fastener system.

16. The personal warming device according to claim 1, wherein said rechargeable battery is contained between said outer shell assembly and said inner liner assembly.

17. The personal warming device according to claim 16, wherein said rechargeable battery supplies 12-volt DC operating voltage.

* * * * *